US009765286B2

(12) United States Patent
Silvernail et al.

(10) Patent No.: US 9,765,286 B2
(45) Date of Patent: Sep. 19, 2017

(54) WAREWASHING COMPOSITION CONTAINING ALKANOL AMINE PHOSPHONATE AND METHODS OF USE

(71) Applicant: Ecolab USA Inc., St. Paul, MN (US)

(72) Inventors: Carter M. Silvernail, Burnsville, MN (US); Erik C. Olson, Savage, MN (US); Kerrie Walters, Minneapolis, MN (US)

(73) Assignee: Ecolab USA Inc., Saint Paul, MN (US)

( * ) Notice: Subject to any disclaimer, the term of this patent is extended or adjusted under 35 U.S.C. 154(b) by 175 days.

(21) Appl. No.: 14/578,878

(22) Filed: Dec. 22, 2014

(65) Prior Publication Data

US 2016/0177233 A1 Jun. 23, 2016

(51) Int. Cl.

| | |
|---|---|
| ***C11D 3/04*** | (2006.01) |
| ***C11D 3/10*** | (2006.01) |
| ***C11D 3/36*** | (2006.01) |
| ***C11D 3/37*** | (2006.01) |

(52) U.S. Cl.

CPC ..... *C11D 3/044* (2013.01); *C11D 3/10* (2013.01); *C11D 3/364* (2013.01); *C11D 3/3765* (2013.01); *C11D 3/3773* (2013.01)

(58) Field of Classification Search

CPC ..... C11D 3/361

See application file for complete search history.

(56) References Cited

U.S. PATENT DOCUMENTS

| | | | | |
|---|---|---|---|---|
| 2,917,528 | A * | 12/1959 | Ramsey | C05D 9/02 252/181 |
| 2,964,549 | A * | 12/1960 | Ramsey | C05D 9/02 556/174 |
| 3,809,654 | A * | 5/1974 | Mitchell | C02F 5/08 210/700 |
| 4,891,159 | A | 1/1990 | Nadolsky | |
| 5,023,001 | A | 6/1991 | Amjad et al. | |
| 5,158,710 | A | 10/1992 | VanEenam | |
| 5,259,974 | A * | 11/1993 | Chen | C07F 9/3817 210/700 |
| 5,322,636 | A * | 6/1994 | Schaper | C07F 9/3817 210/700 |
| 5,338,477 | A * | 8/1994 | Chen | C02F 5/14 210/700 |
| 5,358,642 | A * | 10/1994 | Chen | C02F 5/14 210/700 |
| 5,391,303 | A * | 2/1995 | Schaper | C07F 9/3817 210/700 |
| 5,414,112 | A | 5/1995 | Dragisich | |
| 5,534,157 | A * | 7/1996 | Iman | C02F 5/14 162/30.1 |
| 6,537,960 | B1 | 3/2003 | Ruhr et al. | |
| 6,812,195 | B2 | 11/2004 | Wierenga et al. | |
| 6,835,706 | B2 | 12/2004 | Lentsch et al. | |
| 6,926,836 | B2 * | 8/2005 | Fidoe | C23F 14/02 134/3 |
| 7,087,781 | B2 | 8/2006 | Paladini et al. | |
| 7,642,224 | B2 | 1/2010 | McRae et al. | |
| 7,902,137 | B2 | 3/2011 | Kneipp et al. | |
| 8,123,867 | B2 | 2/2012 | Tropsch | |
| 9,296,631 | B2 * | 3/2016 | Bodnar | C02F 5/12 |
| 2005/0020466 | A1 | 1/2005 | Man et al. | |
| 2006/0089285 | A1 | 4/2006 | Ahmed et al. | |
| 2008/0015133 | A1 | 1/2008 | Rigley et al. | |
| 2009/0082245 | A1 | 3/2009 | Smith et al. | |
| 2009/0093389 | A1 * | 4/2009 | Tijanic | A61L 2/18 510/161 |
| 2010/0000579 | A1 | 1/2010 | Reinbold et al. | |
| 2010/0160202 | A1 | 6/2010 | Housmekerides et al. | |
| 2010/0317559 | A1 | 12/2010 | Ryther et al. | |
| 2010/0323940 | A1 | 12/2010 | Lentsch et al. | |
| 2011/0053819 | A1 | 3/2011 | Preuschen et al. | |
| 2011/0071065 | A1 | 3/2011 | Silvernail et al. | |
| 2011/0237481 | A1 | 9/2011 | Vinson et al. | |
| 2011/0257431 | A1 | 10/2011 | Baumann et al. | |
| 2011/0301072 | A1 | 12/2011 | Smith et al. | |
| 2012/0010117 | A1 | 1/2012 | Seebeck et al. | |
| 2012/0053104 | A1 | 3/2012 | Olson et al. | |
| 2012/0067373 | A1 | 3/2012 | Souter et al. | |

(Continued)

FOREIGN PATENT DOCUMENTS

| | | | | |
|---|---|---|---|---|
| EP | 0812808 | | 12/1997 | |
| EP | 2166092 | | 3/2010 | |
| EP | 2361964 | | 8/2011 | |
| JP | 2002173695 | | 6/2002 | |
| JP | 2008080498 | | 4/2008 | |
| WO | 0058430 | | 10/2000 | |
| WO | WO 2004078662 | A1 * | 9/2004 | C02F 5/02 |
| WO | 2005066324 | | 7/2005 | |
| WO | 2008017339 | | 2/2008 | |
| WO | 2008095562 | | 8/2008 | |
| WO | 2009080498 | | 7/2009 | |
| WO | 2009092699 | | 7/2009 | |

(Continued)

OTHER PUBLICATIONS

ECOLAB USA Inc., PCT/US2013/064748, filed Oct. 13, 2013"The International Search Report and the Written Opinion of the International Searching Authority, or the Declaration", mail date Jan. 28, 2014.

(Continued)

*Primary Examiner* — Gregory Webb

(74) *Attorney, Agent, or Firm* — McKee, Voorhees & Sease, PLC

(57) ABSTRACT

Alkaline ware wash detergents containing an alkali metal alkalinity source and alkanol amine phosphonate scale inhibitors and methods of employing the same for superior cleaning efficacy and hard water scale control are disclosed. Alkanol amine phosphonates beneficially reduce scale build-up, including calcium carbonate scale build-up from alkaline detergents used with hard water sources. Methods of employing the detergent compositions are also disclosed.

20 Claims, No Drawings

(56) References Cited

U.S. PATENT DOCUMENTS

| | | | | |
|---|---|---|---|---|
| 2012/0108484 | A1 | 5/2012 | Becker et al. | |
| 2012/0165237 | A1 | 6/2012 | Silvernail | |
| 2012/0196784 | A1 | 8/2012 | Seebeck et al. | |
| 2014/0116472 | A1 | 5/2014 | Dahlquist et al. | |
| 2014/0303049 | A1* | 10/2014 | Holdsworth | C09K 8/56 507/241 |

FOREIGN PATENT DOCUMENTS

| | | |
|---|---|---|
| WO | 2010045686 | 4/2010 |
| WO | 2011025624 | 3/2011 |
| WO | 2011080540 | 7/2011 |
| WO | 2011100344 | 8/2011 |
| WO | 2011116775 | 9/2011 |
| WO | 2011144699 | 11/2011 |
| WO | 2012025740 | 3/2012 |
| WO | 2012028203 | 3/2012 |
| WO | 2012038755 | 3/2012 |

OTHER PUBLICATIONS

BASF Safety Data Sheet—Trilon M Liquid (30043459/MDS_GEN_US-EN), Version 1.0, (7 pages), Mar. 27, 2006.

LANXESS Energizing Chemistry Safety Data Sheet, 000969/09, Revised Apr. 26, 2004 (4 pages), Oct. 6, 2004.

Industrial Chemicals Division—PQ Corporation, "Bulletin 17-2A Typical Property Data for PQ Liquid Sodium Silicates", 2007 (1 page), Dec. 31, 2007.

Rohm and Haas—Material Safety Data Sheet—ACUMER (TM) 1000 Polymer, (6 pages), Sep. 24, 2007.

PQ Corporation—Material Safety Data Sheet—RU Sodium Silicate Solution, (5 pages), Jun. 13, 2006.

Rohm and Haas—ACUMER 1000 Scale Inhibitor,(2 pages), Jan. 30, 2002.

JP 2008-080498, Fujifilm Corp—Abstract, Apr. 10, 2008.

* cited by examiner

WAREWASHING COMPOSITION CONTAINING ALKANOL AMINE PHOSPHONATE AND METHODS OF USE

FIELD OF THE INVENTION

The present invention relates generally to the field of ware wash detergents and methods of employing the same for superior cleaning efficacy and hard water scale control. The invention more specifically relates to alkaline detergent compositions. In particular, alkaline detergent compositions with alkanol amine phosphonates that beneficially reduce scale build-up, including calcium carbonate scale build-up from alkaline detergents used with hard water sources. Methods of employing the detergent compositions are also disclosed.

BACKGROUND OF THE INVENTION

Alkaline detergents, particularly those intended for institutional and commercial use, in combination with the presence of hard water commonly result in heavy scale formation that is difficult to control. The level of hardness in water can have a deleterious effect in many systems. For example, calcium carbonate precipitation on the surface of ware can negatively impact the aesthetic appearance of the ware, giving an unclean look. In general, hard water refers to water having a level of calcium and magnesium ions in excess of about 100 ppm expressed in units of ppm calcium carbonate. Often, the molar ratio of calcium to magnesium in hard water is about 2:1 or about 3:1. Although most locations have hard water, water hardness tends to vary from one location to another.

The control of such water hardness presents additional difficulty in ware wash applications employing high alkalinity and/or use at elevated temperatures, such as those commonly employed for industrial warewashing. Traditionally, chelating agents and/or threshold agents are employed with high alkaline detergent compositions because of their ability to solubilize metal salts and/or prevent water hardness from scaling and/or precipitating.

Accordingly, it is an objective of the present invention to develop alkaline detergent compositions to address at least one of these problems and/or to offer detergent compositions with usage, environmental and/or safety benefits.

It is a further objective of the claimed invention to develop detergent compositions having both superior calcium carbonate scale control and cleaning performance.

A further object of the invention is an alkaline detergent compositions reducing and/or eliminating scale build-up of treated surfaces using a phosphonate alternative for 2-phosphonobutane-1,2,4-tricarboxylic acid (PBTC) and 1-HydroxyEthylidene-1,1-Diphosphonic Acid (HEDP) that provides superior performance.

BRIEF SUMMARY OF THE INVENTION

An advantage of the invention is the use of an alkaline detergent composition at high temperatures, such as from about 150° F. to about 185° F., with hard water sources, without significant scale build-up on treated surfaces. It is an advantage of the present invention that the alkaline detergent compositions provide beneficial cleaning efficiency along with the reduction and/or elimination of hard water scaling, namely calcium carbonate scaling even at high temperatures commonly employed for industrial warewashing. According to the invention, it is unexpected that the alkaline detergent compositions having pH of a use solution preferably between about 9 and about 12.5 having replacement phosphonates provide such beneficial results.

In an embodiment, the present invention provides an alkaline detergent composition for removing scale and/or inhibiting formation thereof comprising: an alkali metal alkalinity source; an alkanol amine phosphonate scale inhibitor; water; and optionally a water conditioning polymer; wherein a use solution of the composition has a pH from about 9 to about 12.5 and from about 1 ppm to about 75 ppm of the scale inhibitor. In an aspect of the invention, the alkanol amine phosphonate scale inhibitor is a combination linear alkanol amine phosphonate and cyclic alkanol amine phosphonate in a weight ratio of about 1:2 to about 2:1. In a further aspect of the invention, the composition reduces or eliminates scale build-up on treated surfaces.

In an embodiment, the present invention provides An alkaline detergent use solution composition for removing scale and/or inhibiting formation thereof comprising: from about 100 ppm to about 800 ppm alkali metal alkalinity source; from about 1 ppm to about 75 ppm alkanol amine phosphonate scale inhibitor; water; and from about 1 ppm to about 100 ppm water conditioning polymer; wherein the use solution has a pH from about 9 to about 12.5. In a further aspect, the use solution is substantially-free of 2-phosphonobutane-1,2,4-tricarboxylic acid (PBTC) and/or 1-HydroxyEthylidene-1,1-Diphosphonic Acid (HEDP) phosphonates.

In a still further embodiment, the present invention is a method of warewashing and/or reducing or eliminating hard water scale during a wash cycle. The method may include first diluting an alkaline detergent concentrate according to the invention to form a detergent use solution. The method includes washing a surface with an alkaline detergent use solution having a pH between about 9 and about 12.5 comprising from about 100 ppm to about 800 ppm alkali alkalinity source and/or secondary alkalinity source, from about 1 ppm to about 75 ppm alkanol amine phosphonate scale inhibitor, and optionally from about 1 ppm to about 100 ppm water conditioning polymer and/or additional functional ingredients. In an aspect, the alkaline detergent use solution is formed by diluting the concentrated alkaline detergent composition with water from about 1:500 to about 1:5000.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE PREFERRED EMBODIMENT

The embodiments of this invention are not limited to particular industrial and/or high temperature, alkaline ware wash detergent compositions, which can vary and are understood by skilled artisans, based on the disclosure of the present invention. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the phrase "cleaning" refers to performing or aiding in soil removal, bleaching, de-scaling, de-staining, microbial population reduction, rinsing, or combination thereof.

The phrase "detergent composition" refers to the detergent composition provided as a concentrate or as a use composition according to the invention, which may be provided in a variety of formulations, including for example liquid, solid, powder, paste or gel. The term "concentrate" refers to a relatively concentrated form of the detergent composition that can be diluted with a diluent to form a use composition. An exemplary diluent that can be used to dilute the concentrate to form the use composition is water. In general, the use composition refers to the composition that contacts an article to provide a desired action. For example, a warewashing detergent composition that is provided as a use composition can contact ware for cleaning the ware. In addition, the concentrate or the diluted concentrate can be provided as the use composition. For example, the concentrate can be referred to as the use composition when it is applied to an article without dilution. In many situations, it is expected that the concentrate will be diluted to provide a use composition that is then applied to an article. In some preferred aspects, the dilution ratio of the alkaline detergent composition is from about 1:500 to about 1:5000 in water.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%. For example, in an aspect of the invention, the detergent compositions are substantially 2-phosphonobutane-1,2,4-tricarboxylic acid (PBTC) free and/or 1-HydroxyEthylidene-1,1-Diphosphonic Acid (HEDP) free.

The term "threshold agent" refers to a compound that inhibits crystallization of water hardness ions from solution, but that need not form a specific complex with the water hardness ion. Threshold agents suitable for various cleaning applications include but are not limited to a polycarboxylic acid polymers, polyacrylate, a polymethacrylate, an olefin/maleic copolymer, and the like. Further description of particularly suitable threshold agents according to the invention is disclosed herein.

As used herein, the term "ware" generally refers to items such as eating and cooking utensils, dishes, and other hard surfaces. Ware also refers to items made of various substrates, including glass, metal, plastic, etc. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET). As used herein, the term "warewashing" refers to washing, cleaning, or rinsing ware.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

While an understanding of the mechanism is not necessary to practice the present invention and while the present invention is not limited to any particular mechanism of action, it is contemplated that, in some embodiments, the alkaline detergent compositions employ an alkanol amine phosphonate in combination with an alkalinity source(s) to beneficially provide alkaline detergent compositions with improved cleaning efficacy and reduction of hard water scale, such as calcium carbonate scale, as an unexpected result of the higher calcium stability of the alkanol amine phosphonate. Beneficially, the pH of the alkaline detergent compositions in use solution remains moderate to highly alkaline, preferably from about 9 to about 12.5 without having any deleterious effects of hard water scaling, as occurs with lower calcium soluble components, often resulting in precipitation, clogging of dispensers and other processing components, etc. As a further benefit, the alkaline detergent compositions in use solution require low concentrations of the alkanol amine phosphonate, preferably between about 1 ppm to about 75 ppm, without having any deleterious effects of hard water scaling. As a result, the compositions described herein provide effective replacements for 2-phosphonobutane-1,2,4-tricarboxylic acid (PBTC) and/or 1-HydroxyEthylidene-1,1-Diphosphonic Acid (HEDP) phosphonates for hard water scale control.

Detergent Compositions

According to an embodiment of the invention the alkaline detergent compositions reduce and/or prevent scale build-up. In preferred embodiment of the invention the alkaline, preferably alkali metal hydroxide-containing, detergent compositions substantially eliminate or completely eliminate scale build-up on treated surfaces (e.g. glasses or other ware). In some embodiments, the alkaline detergent compositions comprise, consist of and/or consist essentially of at least one alkanol amine phosphonate scale inhibitor, at least one alkalinity source, and water. In additional embodiments, the alkaline detergent compositions further comprise, consist of and/or consist essentially of a monoethanolamine phosphonate scale inhibitor, at least one alkalinity source, water, a water conditioning polymer, and optionally additional functional ingredient(s). Unexpectedly, these alkaline detergent compositions reduce and/or eliminate scaling on the treated surfaces while provide improved cleaning efficacy in comparison to many conventional phosphonates.

Scale Inhibitors—Alkanol Amine Phosphonates

The scale inhibitors component according to the invention includes an alkanol amine phosphonate. In an aspect, the alkanol amine phosphonate includes a combination of linear and cyclic alkanol amine phosphonates.

In an aspect, the linear and cyclic alkanol amine phosphonates have the formulas (I (linear) and II (cyclic)) below:

I

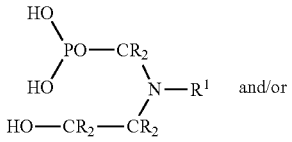

and/or

II

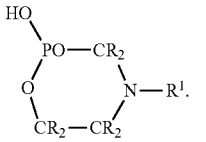

Wherein R may be —H, —$CH_3$, —$C_2H_5$, —$OHCH_2$ or $R_1$, $R_1$ may be —$OHCH_2$ or $[(CR_2)_nNCR_2PO_3H_2]mCR_2PO_3H_2$, wherein m is 0 to 10 and n is 2 or 3.

In a preferred aspect, the linear and cyclic alkanol amine phosphonates are monoethanolamine phosphonates.

The linear monoethanolamine phosphonates suitable for use as scale inhibitors according to the invention have the formula (III) below:

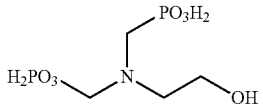

The cyclical monoethanolamine phosphonates suitable for use as scale inhibitors according to the invention have the formula (IV) below:

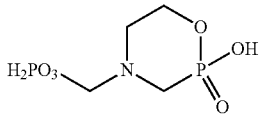

In an aspect the weight ratio of the linear alkanol amine phosphonate to the cyclic alkanol amine phosphonate scale inhibitor is from about 1:10 to about 10:1, preferably from about 1:5 to about 5:1, and more preferably from about 1:2 to about 2:1.

In an aspect, the detergent compositions in a use solution provide scale inhibition at a substantial reduction in concentration when employing the alkanol amine phosphonate according to the invention in comparison to conventional phosphonate scale inhibitors. In an aspect, a use solution requires less than 100 ppm alkanol amine phosphonate scale inhibitor. This provides a significant benefit in comparison to conventional scale inhibitor compositions employing use concentrations having significantly increased concentrations, including from about 0.01 wt-% to about 5 wt-% (above 100 ppm to about 50,000 ppm), such as that disclosed in U.S. Patent Publication No. 2010/0000579 (Reinbold et al.), which is incorporated herein by reference in its entirety. Beneficially, the use solutions employing alkanol amine phosphonate scale inhibitors according to the invention employ from about 1 ppm to about 75 ppm scale inhibitor. In some aspects, the use solutions employ 75 ppm or less scale inhibitor, from about 40 ppm to about 65 ppm, 50 ppm or less scale inhibitor, or 25 ppm or less scale inhibitor. In addition, without being limited according to the invention, all ranges recited are inclusive of the numbers defining the range and include each integer within the defined range. A further benefit of the alkanol amine phosphonate scale inhibitors according to the invention is that no further scale inhibitors are required for efficacious scale inhibition. In an aspect of the invention, the scale inhibitor consists of and/or consists essentially of the alkanol amine phosphonate scale inhibitors.

In an aspect, the detergent compositions include from about 0.1 wt-%-25 wt-% scale inhibitor, from about 0.5 wt-%-20 wt-% scale inhibitor, from about 1 wt-%-20 wt-% scale inhibitor, preferably from about 2 wt-%-15 wt-% scale inhibitor. In addition, without being limited according to the invention, all ranges recited are inclusive of the numbers defining the range and include each integer within the defined range. In a further aspect, the scale inhibitor, preferably the monoethanolamine phosphonate scale inhibitor is present at a level such that a use solution of the detergent in hard water (e.g. 17 or 20 grain water hardness) does not lead to the formation of precipitate.

In an aspect, the monoethanolamine phosphonate scale inhibitor can achieve scale control independent of the optional water conditioning agents (discussed below) of the invention. However, it has been found that there is a beneficial and/or synergistic effect between the chemistries in the alkaline detergent composition according to the invention that allows scale control in concentrated and use solution alkaline detergent compositions. Beneficially, in some aspects the combination of chemistries eliminates the need for surfactants, enzymes, additional polymers and the like.

Alkalinity Source(s)

In an embodiment the detergent compositions includes at least one alkalinity source that is compatible with the other components of the detergent composition and that will provide a use solution with the desired pH. One or more alkaline sources can be used to enhance cleaning of a substrate and improve soil removal performance of the detergent composition.

Alkalinity sources suitable for the invention are well known as those that contain alkali or alkaline earth metal hydroxides, carbonates, bicarbonates, sesquicarbonates, borates, silicates, phosphates and mixtures thereof. The alkali or alkaline earth metals include such components as sodium, potassium, calcium, magnesium, barium and the like. Silicates include all of the usual silicates used in cleaning such as metasilicates, silicates and the like. It is to be appreciated that phosphate includes all the broad class of phosphate materials, such as phosphates, pyrophosphates, polyphosphates (such as tripolyphosphate) and the like.

Preferably an alkali metal hydroxide alkalinity source, such as sodium hydroxide or potassium hydroxide, is employed. A still further benefit of the alkanol amine phosphonate scale inhibitor compositions according to the invention is reduced caustic concentrations employed therewith in comparison to certain scale inhibitor compositions, such as those disclosed in U.S. Patent Publication No. 2010/0000579 (Reinbold et al.) Beneficially, the use solutions employing alkanol amine phosphonate scale inhibitors according to the invention employ from about 100 ppm to about 800 ppm alkalinity, preferably alkali metal hydroxide. In some aspects, the use solutions employ less than 800 ppm alkalinity, preferably alkali metal hydroxide, less than 750 ppm alkalinity, less than 500 ppm alkalinity, or less than 250 ppm alkalinity. In addition, without being limited according to the invention, all ranges recited are inclusive of the numbers defining the range and include each integer within the defined range.

In an aspect of the invention, the alkalinity source(s) may be added to the composition in any form known in the art, including as solid beads, dissolved in an aqueous solution, or a combination thereof.

In an aspect, the detergent compositions include from about 10 wt-%-90 wt-% alkalinity source(s), from about 15 wt-%-90 wt-% alkalinity source(s), from about 10 wt-%-80 wt-% alkalinity source(s), from about 10 wt-%-75 wt-% alkalinity source(s), from about 10 wt-%-70 wt-% alkalinity source(s), from about 20 wt-%-75 wt-% alkalinity source(s), and preferably from about 30 wt-%-75 wt-% alkalinity source(s). In addition, without being limited according to the invention, all ranges recited are inclusive of the numbers defining the range and include each integer within the defined range.

The alkalinity source(s) is provided in a sufficient amount to maintain an alkaline pH in a use solution in order to provide sufficient detergency properties. An effective amount of one or more alkalinity sources should be considered as an amount that provides a concentrate composition having a pH of about 12. In a further aspect an effective amount of one or more alkalinity sources should be considered as an amount that provides a use composition having a pH of at least from about 9 to about 12.5. When the use composition has a pH of between about 8 and about 10, it can be considered mildly alkaline, and when the pH is greater than about 12, the use composition can be considered caustic. Particularly, the pH of the use solution of the detergent composition is between about 9 and about 12.5, preferably between about 9 and about 11.5. In addition, without being limited according to the invention, all ranges recited are inclusive of the numbers defining the range and include each integer within the defined range. If the pH of the use solution is too low, for example, below approximately 9, the use solution may not provide adequate detergency properties. If the pH of the use solution is too high, for example, above approximately 12.5-13, the use solution may be too alkaline and attack or damage the surface to be cleaned as well as require additional safety considerations for transport and/or handling of the highly alkaline detergent.

Water Conditioning Polymers

In an embodiment the detergent compositions optionally include water conditioning polymer(s). In some aspects a water conditioning polymer is a secondary builder or scale inhibitor for the alkaline detergent compositions according to the invention. Without being limited to a particular theory of the invention, the combined use of the alkanol amine phosphonate scale inhibitors and water conditioning polymer provide at least an additive and/or synergistic inhibition of scale build-up on treated surfaces employing the alkaline detergent composition according to the invention.

According to an embodiment of the invention, the water conditioning polymer may be a non-phosphorus polymer. In an aspect, the water conditioning polymer is a nonionic surfactant. In an aspect, the water conditioning polymer is a polycarboxylic acid and/or a hydrophobically modified polycarboxylic acid. An exemplary polyacrylic acid is commercially-available as Acusol® 445N (Dow Chemical).

In a further embodiment, a neutralized polycarboxylic acid polymer is employed as the water conditioning polymer. An exemplary neutralized polycarboxylic acid is commercially-available as Acumer® 1000 (Rohm & Haas Company).

In a further aspect, the water conditioning polymer can include a polycarboxylates or related copolymer. Polycarboxylates refer to compounds having a plurality of carboxylate groups. A variety of such polycarboxylate polymers and copolymers are known and described in patent and other literature, and are available commercially. Exemplary polycarboxylates that can be used as builders and/or water conditioning polymers include, but are not limited to: those having pendant carboxylate ($—CO_2^-$) groups such as acrylic homopolymers, polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. In a further aspect, polycarboxylates that can be used as builders and/or water conditioning polymers include, but are not limited to: homopolymers and copolymers of polyacrylates; polyacrylates; polymethacrylates; noncarboxylated materials such as polyolefinic and polymaleic copolymers, such as olefinic and maleic hydride copolymers; and derivatives and salts of all of the same. Additional description of exemplary polycarboxylates and polyacrylates is provided in U.S. Pat. Nos. 7,537,705 and 3,887,806.

In a further aspect, the water conditioning polymer can include a polyacrylate or related copolymer. Suitable polyacrylates, homopolymers and copolymers of polyacrylates, polyolefinic and polymaleic systems according to the invention may include organic compounds, including both polymeric and small molecule agents, including for example polyanionic compositions, such as polyacrylic acid compounds. Polymeric agents commonly comprise polyanionic compositions such as polyacrylic acid compounds. For example, exemplary commercially available acrylic-type polymers include acrylic acid polymers, methacrylic acid polymers, acrylic acid-methacrylic acid copolymers, and water-soluble salts of the said polymers. These include polyelectrolytes such as water soluble acrylic polymers such as polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, hydrolyzed methacrylamide, hydrolyzed acrylamide-methacrylamide copolymers, and combinations thereof. Such polymers, or mixtures thereof, include water soluble salts or partial salts of these polymers such as their respective alkali metal (for example, sodium or potassium) or ammonium salts can also be used.

In an additional embodiment, the compositions of the present invention provide a suitable replacement for various phosphonic acids. In some embodiments the compositions include less than about 0.5 wt-% elemental phosphorus and/or do not include phosphonic acids, including for example, aminotri(methylenephosphonic acid) (ATMP), 1-hydroxyethylidine-1,1-diphosphonic acid, hexamethylenediamine tetra(methylenephosphonic acid), 2-hydroxyethyliminobis(methylenephosphonic acid), bis(hexamethylene)triamine(pentamethylenephosphonic acid), diethylenetriaminepenta(methylenephosphonic acid), ethylenediamine tetra(methylenephosphonic acid) (EDTMPA) and/or phosphorus acid. In other embodiments such phosphonic acids may be used in combination with the alkanol amine phosphonates described herein.

In an additional embodiment, the compositions of the present invention provide a suitable replacement for various aminocarboxylic acids/salts. In some embodiments the compositions do not require aminocarboxylic acids/salt, such as ethylenediaminetetraacetic acid (EDTA), nitrilotriacetic acid (NTA), diethylenetriaminepentaacetic acid (DTPA), N-hydroxyethyl-ethylenediaminetriacetic acid (HEDTA), ethylenediamine disuccinic acid (EDDS), iminodisuccinic acid (IDS), methylglycinediacetic acid (MGDA), beta-alaninediacetic acid (beta-ADA), N-hydroxyethyliminodiacetic acid, ethylenedioxydiethylenedinitrilotetraacetic acid, ethylene glycol-bis(2-aminoethyl)-N,N,N',N'-tetraacetic acid (EGTA), triethanolamine (TEA), ferrioxamines and/or N,N-bis(carboxylatomethyl)-L-glutamic acid. In other embodiments such aminocarboxylic acids/salts may be used in combination with the alkanol amine phosphonates described herein.

In an embodiment, fully neutralized salts of the water conditioning polymer are used to avoid generating heat when an acid reacts with an alkaline agent.

For a further discussion of water conditioning polymers, see Kirk-Othmer, Encyclopedia of Chemical Technology, Third Edition, volume 5, pages 339-366 and volume 23, pages 319-320, the disclosure of which is incorporated by reference herein.

In an aspect, the detergent compositions include from about 0.1 wt-%-25 wt-% water conditioning polymer, from about 0.1 wt-%-20 wt-% water conditioning polymer, from about 1 wt-%-20 wt-% water conditioning polymer, preferably from about 1 wt-%-15 wt-% water conditioning polymer. In addition, without being limited according to the invention, all ranges recited are inclusive of the numbers defining the range and include each integer within the defined range. In a further aspect, the water conditioning polymer is present at a level such that a use solution of the detergent in hard water (e.g. 17 or 20 grain water hardness) does not lead to the formation of precipitate.

Water

In an embodiment the detergent compositions includes water. Preferably, the detergent compositions are formulated into liquid compositions. The water employed in the compositions can be from a variety of sources and may include hard and/or softened or treated water.

In an aspect, the detergent compositions include from about 20 wt-%-80 wt-% water, from about 20 wt-%-60 wt-% water, from about 30 wt-%-80 wt-% water, from about 40 wt-%-80 wt-% water, preferably from about 50 wt-%-70 wt-% water. In addition, without being limited according to the invention, all ranges recited are inclusive of the numbers defining the range and include each integer within the defined range.

Additional Functional Ingredients

The components of the alkaline detergent composition can further be combined with various functional components suitable for use in ware wash applications. In some embodiments, the detergent composition including the alkanol amine phosphonates, alkalinity source(s), water, and optional water conditioning polymers make up a large amount, or even substantially all of the total weight of the detergent composition. For example, in some embodiments few or no additional functional ingredients are disposed therein.

In other embodiments, additional functional ingredients may be included in the alkaline detergent compositions. The functional ingredients provide desired properties and functionalities to the scale-reducing alkaline detergent compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning, specifically ware wash applications. However, other embodiments may include functional ingredients for use in other applications.

In preferred embodiments, the alkaline detergent compositions do not include enzymes. In preferred embodiments, the alkaline detergent compositions do not include chlorine or a chlorine source, such as various bleaching agents. In further preferred embodiments, the detergent compositions do not include additional surfactants and/or only nonionic surfactants. In still further preferred embodiments, the alkaline detergent compositions do not include additional phosphate and/or phosphonate builders and/or chelating agents. In preferred aspects of the invention, the alkaline detergent compositions are free of 2-phosphonobutane-1,2,4-tricarboxylic acid (PBTC) and 1-HydroxyEthylidene-1,1-Diphosphonic Acid (HEDP).

In some embodiments, the alkaline detergent compositions may include polymers that are defoaming agents, anti-redeposition agents, bleaching agents, solubility modifiers, dispersants, rinse aids, metal protecting agents, stabilizing agents, sequestrants, corrosion inhibitors, sanitizing agents or antimicrobial agents, additional sequestrants and/or chelating agents, fragrances and/or dyes, rheology modifiers or thickeners, hydrotropes or couplers, buffers, solvents and the like. In an aspect, the alkaline detergent compositions include a food grade rinse aid, including for example a GRAS product. The term "generally recognized as safe" or "GRAS," as used herein refers to components classified by the Food and Drug Administration as safe for direct human food consumption or as an ingredient based upon current good manufacturing practice conditions of use, as defined for example in 21 C.F.R. Chapter 1, §170.38 and/or 570.38.

Surfactants

The alkaline detergent compositions can include additional surfactants, including, but not limited to: anionic, nonionic, cationic, amphoteric and zwitterionic surfactants. Additional surfactants are an optional component of the alkaline detergent composition and can be excluded from the compositions. Exemplary surfactants that can be used are commercially available from a number of sources. For a discussion of surfactants, see Kirk-Othmer, Encyclopedia of Chemical Technology, Third Edition, volume 8, pages 900-912, which is herein incorporated by reference in its entirety. The alkaline detergent composition, when provided as a concentrate, can include the surfactants in a range of about 0.05% to about 20% by weight, about 0.5% to about 10% by weight, about 1% to about 10% by weight, about 1.5% to about 10% by weight, and about 2% to about 8% by weight. In other embodiments, the compositions of the present invention include about 0-40 wt-% of a surfactant. In other embodiments the compositions of the present invention include about 0-25 wt-% of a surfactant.

In certain embodiments of the invention the alkaline detergent composition does not require an additional surfactant and/or other polymers in addition to the alkanolamine phosphonates and/or water conditioning polymers. In alternative embodiments, the detergent compositions employ a nonionic surfactant (in addition to or as the water conditioning polymer). In an embodiment, the alkaline detergent composition may employ an alcohol ethoxylate as the nonionic surfactant and/or water conditioning polymer.

Nonionic Surfactants

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic® and reverse Pluronic® surfactants; alcohol alkoxylates; capped alcohol alkoxylates; mixtures thereof, or the like.

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

Alkoxylated amines or, most particularly, alcohol alkoxylated/aminated/alkoxylated surfactants are also suitable for use according to the invention. These non-ionic surfactants may be at least in part represented by the general formulae: $R^{20}$—$(PO)_S$N-$(EO)_t$H, $R^{20}$—$(PO)_S$N-$(EO)_t$H$(EO)_t$H, and $R^{20}$—N$(EO)_t$H; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—N[$(EO)_w$H][$(EO)_z$H] in which $R^{20}$ is as defined above, v is 1 to 20 (e.g., 1, 2, 3, or 4 (preferably 2)), and w and z are independently 1-10, preferably 2-5.

Block polyoxypropylene-polyoxyethylene polymeric compounds based upon propylene glycol, ethylene glycol, glycerol, trimethylolpropane, and ethylenediamine as the initiator reactive hydrogen compound are suitable nonionic surfactants. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Defoaming Agents

A defoaming agent for reducing the stability of foam may also be included in the alkaline detergent composition. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane; fatty amides, hydrocarbon waxes, fatty acids, fatty esters, fatty alcohols, fatty acid soaps, ethoxylates, mineral oils, and polyethylene glycol esters. A discussion of defoaming agents may be found, for example, in U.S. Pat. Nos. 3,048,548, 3,334,147, and 3,442,242, the disclosures of which are incorporated herein by reference. When the concentrate includes a defoaming agent, the defoaming agent can be provided in an amount of between approximately 0.0001% and approximately 10% by weight, between approximately 0.001% and approximately 5% by weight, or between approximately 0.01% and approximately 1.0% by weight. All ranges recited are inclusive of the numbers defining the range and include each integer within the defined range.

Anti-Redeposition Agents

The alkaline detergent composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, hydroxypropyl cellulose and carboxymethyl cellulose. When the concentrate includes an anti-redeposition agent, the anti-redeposition agent can be included in an amount of between approximately 0.5% and approximately 10% by weight, and between approximately 1% and approximately 5% by weight. All ranges recited are inclusive of the numbers defining the range and include each integer within the defined range.

Stabilizing Agents

The alkaline detergent composition may also include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to approximately 20% by weight, between approximately 0.05% and approximately 15% by weight, and between approximately 0.1% and approximately 10% by weight. All ranges recited are inclusive of the numbers defining the range and include each integer within the defined range.

Glass and Metal Corrosion Inhibitors

The alkaline detergent composition can include a metal corrosion inhibitor in an amount up to approximately 50% by weight, between approximately 0.01% and approximately 40% by weight, or between approximately 0.1% and approximately 30% by weight. All ranges recited are inclusive of the numbers defining the range and include each integer within the defined range.

The corrosion inhibitor is included in the detergent composition in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least approximately 6 parts per million (ppm) of the corrosion inhibitor to provide desired corrosion inhibition properties. It is expected that larger amounts of corrosion inhibitor can be used in the use solution without deleterious effects. The use solution can include between approximately 6 ppm and approximately 300 ppm of the corrosion inhibitor, and between approximately 20 ppm and approximately 200 ppm of the corrosion inhibitor. Examples of suitable corrosion inhibitors include, but are not limited to: a combination of a source of aluminum ion and a source of zinc ion, as well as an alkaline metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the solid detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof.

Silicates can be included in the detergent composition to provide for metal protection but are additionally known to provide alkalinity and additionally function as anti-redeposition agents. Exemplary silicates include, but are not limited to: sodium silicate and potassium silicate. The detergent composition can be provided without silicates, but when silicates are included, they can be included in amounts that provide for desired metal protection. The concentrate can include silicates in amounts of at least approximately 1% by weight, at least approximately 5% by weight, at least approximately 10% by weight, and at least approximately 15% by weight. In addition, in order to provide sufficient room for other components in the concentrate, the silicate component can be provided at a level of less than approximately 35% by weight, less than approximately 25% by weight, less than approximately 20% by weight, and less than approximately 15% by weight.

Thickeners

The alkaline detergent compositions can include a rheology modifier or a thickener in amounts suitable for adjusting the thickness of a particular composition to particular viscosity, such amounts which shall vary. A rheology modifier or a thickener can be provided in an amount of between approximately 0.0001% and approximately 10% by weight, between approximately 0.001% and approximately 10% by weight, or between approximately 0.01% and approximately 10% by weight. All ranges recited are inclusive of the numbers defining the range and include each integer within the defined range.

The rheology modifier may provide the following functions: increasing the viscosity of the compositions; increasing the particle size of liquid use solutions when dispensed through a spray nozzle; providing the use solutions with vertical cling to surfaces; providing particle suspension within the use solutions; or reducing the evaporation rate of the use solutions. Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol®, available from Rohm & Haas Company, Philadelphia, Pa.; and Carbopol®, available from B.F. Goodrich, Charlotte, N.C. Additional examples of suitable polymeric thickeners include, but not limited to: polysaccharides, including but not limited to, xanthans.

Rinse Aids

The alkaline detergent composition can optionally include a rinse aid composition, for example a rinse aid formulation containing a wetting or sheeting agent combined with other optional ingredients in a solid composition made using the binding agent. The rinse aid components are capable of reducing the surface tension of the rinse water to promote sheeting action and/or to prevent spotting or streaking caused by beaded water after rinsing is complete, for example in warewashing processes. Examples of sheeting agents include, but are not limited to: poly ether compounds prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Additional disclosure of suitable rinse aids is provided in U.S. Patent Publication No. 2011/0301072, which is herein incorporated by reference in its entirety.

Exemplary ranges of rinse aids include up to approximately 20% by weight, between approximately 0.01% and approximately 15% by weight, and between approximately 0.1% and approximately 10% by weight. All ranges recited are inclusive of the numbers defining the range and include each integer within the defined range.

Sanitizers/Anti-Microbial Agents

The alkaline detergent composition can optionally include and/or be used in a ware wash application with a sanitizing composition (or antimicrobial agent). Sanitizing agents, also known as antimicrobial agents, are chemical compositions that can be used to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, anilides, organosulfur and sulfur-nitrogen compounds and miscellaneous compounds.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Sanitizing compounds capable of liberating an active halogen species, such as $Cl_2$, $Br_2$, —OCl— and/or —OBr—, or the like, under conditions typically encountered during the cleansing process may be used. Examples of suitable halogen-releasing compounds include, but are not limited to: chlorine-containing compounds such as chlorine, a hypochlorite or chloramines, and alkali metal dichloroisocyanurates, alkali metal hypochlorites, monochloramine, and dichloroamine. Encapsulated chlorine sources may also be used to enhance the stability of the chlorine source in the composition (see, for example, U.S. Pat. Nos. 4,618,914 and 4,830,773, the disclosures of which are incorporated by reference herein in their entirety).

Examples of suitable antimicrobial agents include, but are not limited to, phenolic antimicrobials such as pentachlorophenol; orthophenylphenol; chloro-p-benzylphenols; p-chloro-m-xylenol; quaternary ammonium compounds such as alkyl dimethylbenzyl ammonium chloride; alkyl dimethylethylbenzyl ammonium chloride; octyl decyldimethyl ammonium chloride; dioctyl dimethyl ammonium chloride; and didecyl dimethyl ammonium chloride. Examples of suitable halogen containing antibacterial agents include, but are not limited to: sodium trichloroisocyanurate, sodium dichloro isocyanate (anhydrous or dihydrate), iodine-poly(vinylpyrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, and tetramethyl phosphonium tribromide. Other antimicrobial compositions such as hexahydro-1,3,5-tris(2-hydroxyethyl)-s-triazine, dithiocarbamates such as sodium dimethyldithiocarbamate, percarbonate, iodine solutions, and a variety of other materials are known in the art for their antimicrobial properties.

Exemplary ranges of antimicrobial agents include up to approximately 30% by weight, between approximately 0.01% and approximately 20% by weight, and between approximately 0.1% and approximately 15% by weight. All ranges recited are inclusive of the numbers defining the range and include each integer within the defined range.

Dyes and Fragrances

Various dyes, odorants including perfumes, and other aesthetic enhancing agents may also be included in the alkaline detergent composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (BASF), Pylakor Acid Bright Red (Pylam), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Exemplary ranges of dyes and/or fragrances include up to approximately 20% by weight, between approximately 0.01% and approximately 15% by weight, and between approximately 0.1% and approximately 10% by weight. All ranges recited are inclusive of the numbers defining the range and include each integer within the defined range.

EMBODIMENTS

Exemplary ranges of the concentrated alkaline detergent compositions according to the invention are shown in Table 1 in weight percentage of the detergent compositions.

TABLE 1

| Material | First Exemplary Range wt-% | Second Exemplary Range wt-% | Third Exemplary Range wt-% |
|---|---|---|---|
| Water | 0.1-50 | 0.5-50 | 1-40 |
| Alkalinity Source(s) | 25-95 | 25-90 | 40-75 |
| Alkanol Amine Phosphonate Scale Inhibitor | 1-50 | 10-50 | 5-20 |
| Water Conditioning Polymer | 0-50 | 0.1-50 | 1-40 |
| Additional Functional Ingredients | 0-75 | 0-50 | 0-25 |

Exemplary ranges of the use solutions of the alkaline detergent compositions according to the invention are shown in Table 2 in weight percentage of the detergent compositions.

TABLE 2

| Material | First Exemplary PPM | Second Exemplary PPM | Third Exemplary PPM |
|---|---|---|---|
| Water | — | — | — |
| Alkalinity Source(s) | 1-1000 | 10-800 | 100-750 |
| Alkanol Amine Phosphonate Scale Inhibitor | 1-200 | 1-75 | 10-30 |

TABLE 2-continued

| Material | First Exemplary PPM | Second Exemplary PPM | Third Exemplary PPM |
|---|---|---|---|
| Water Conditioning Polymer | 0-100 | 1-75 | 10-60 |
| Additional Functional Ingredients | 0-1000 | 0-250 | 0-200 |

In some a use solution of the alkaline detergent compositions provides active phosphonate (ppm) of at least about 1 ppm, at least about 5 ppm, at least about 10 ppm, from about 10-30 ppm, from about 1-75 ppm or up to about 200 ppm. In other aspects, a use solution of the alkaline detergent compositions provides active phosphonate and water conditioning polymer (total ppm) of at least about 30 ppm, at least about 40 ppm, at least about 50 ppm, or at least about 60 ppm, or at least about 100 ppm, or at least about 200 ppm. In addition, without being limited according to the invention, all ranges for the ratios recited are inclusive of the numbers defining the range and include each integer within the defined range of ratios.

In still further aspects, a use solution of the alkaline detergent composition provides a total use concentration (ppm) of at least about 250 ppm, at least about 500 ppm, at least about 750 ppm, or preferably from about 500-750 ppm. In an aspect, the use solution of the alkaline detergent composition provides a total use concentration (ppm) below at least about 1,000 ppm, preferably below at about 750 ppm. In addition, without being limited according to the invention, all ranges for the ratios recited are inclusive of the numbers defining the range and include each integer within the defined range of ratios.

The alkaline detergent compositions may include concentrate compositions or may be diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as a concentrate or a use composition (or use solution) dependent upon the formulation employed in methods according to the invention.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed and the like. In an embodiment, the concentrate is diluted at a ratio of between about 1:5 or about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:100 and about 1:2,500 or between about 1:250 and about 1:2,000 concentrate to water.

In an aspect of the invention, the detergent composition preferably provides efficacious cleaning at low use dilutions, i.e., require less volume to clean effectively. In an aspect, a concentrated liquid detergent composition may be diluted in water prior to use at dilutions ranging from about 1:500 to about 1:5000, or ranging from at least 1/16 oz./gal. to at least about 2 oz./gal., or more. A detergent concentrate that requires less volume to achieve the same or better cleaning efficacy and provides hardness scale control and/or other benefits at low use dilutions is desirable.

Methods Employing the Present Compositions

The methods of employing the alkaline detergent compositions are particularly suited for use in closed systems, e.g. dish or ware washing systems for cleaning, sanitizing and/or disinfecting articles and surfaces. According to an embodiment of the invention the alkaline detergent compositions are particularly well suited for industrial or institutional ware washing to clean treated surfaces. In an embodiment the methods can result in reduced scaling (i.e. enhanced scale control) on treated surfaces and improved or enhanced cleaning performance of the alkaline detergent composition. The methods of the invention are particularly suited for industrial or institutional applications which conventionally employ phosphonates and higher temperature conditions for both washing and rinsing applications.

The methods include contacting an article or surface with the alkaline detergent composition or a detergent use composition according to the invention to wash the surface. The methods can contact the liquid to any of a variety of surfaces or objects including surfaces or articles including those made of glass, ceramic, plastic, porcelain, aluminum, or the like.

The phrase "washing a surface with a detergent wash solution (or a use solution or a detergent composition)" refers to the circulation of the alkaline detergent composition solution to remove substantially all soil from the treated surfaces (e.g. ware) and to keep that soil suspended or dissolved without causing hard water scale accumulation. In an embodiment, this step may be conducted where the temperature of the wash water is up to or greater than about 150° F., often in the range of about 150° F. to 165° F. In an embodiment the rinse water employed for a rinse step is up to or greater than about 170° F., often in the range of 170° F. to 185° F. The ranges for wash and rinse within industrial or institutional ware washing machines are often referred to as "high temperature."

In an embodiment, the present invention includes a method of cleaning an article or surface while also reducing scale hardness build-up on the article or surface. This method can include: providing the alkaline detergent composition in a use solution to a surface and/or article in need of treatment. In an aspect, the alkaline detergent use composition comprises an alkali metal alkalinity source; an alkanol amine phosphonate scale inhibitor; water; and optionally a water conditioning polymer; wherein a use solution of the composition has a pH from about 9 to about 12.5 and from about 1 ppm to about 75 ppm of the scale inhibitor. In an aspect, the alkanol amine phosphonate scale inhibitor is a combination linear alkanol amine phosphonate and cyclic alkanol amine phosphonate in a weight ratio of about 1:2 to about 2:1. In a further aspect, these methods employing the composition reduce or eliminate scale build-up on treated surfaces.

In an aspect, the alkaline detergent use composition for removing scale and/or inhibiting formation thereof comprises from about 100 ppm to about 800 ppm alkali metal alkalinity source; from about 1 ppm to about 75 ppm alkanol amine phosphonate scale inhibitor; water; and from about 1 ppm to about 100 ppm water conditioning polymer. In a further aspect, the use solution has a pH from about 9 to about 12.5. In a further aspect, the use solution is substantially-free of 2-phosphonobutane-1,2,4-tricarboxylic acid (PBTC) and/or 1-HydroxyEthylidene-1,1-Diphosphonic Acid (HEDP) phosphonates and/or phosphonic acids. In a further aspect, the use solution has less than about 0.5% elemental phosphorus.

Contacting can include any of numerous methods for applying a composition, such as spraying the composition, immersing the object in the composition, or a combination thereof. A concentrate or use concentration of a composition of the present invention can be applied to or brought into contact with an article by any conventional method or apparatus for applying a cleaning composition to an object. For example, the object can be wiped with, sprayed with, and/or immersed in the composition, or a use solution made from the composition. The composition can be sprayed, or wiped onto a surface; the composition can be caused to flow over the surface, or the surface can be dipped into the composition. Contacting can be manual or by machine.

Before contacting an article or surface, a concentrate detergent composition may be first diluted with water prior to or at the location of use to provide the use solution. In an aspect, the alkaline detergent use solution is formed by diluting the concentrated alkaline detergent composition with water from about 1:500 to about 1:5000. When the composition is used in an automatic warewashing or dishwashing machine, it is expected that that the location of use will be inside the automatic warewashing machine. Depending on the machine, the composition may be provided in a unit dose form or in a multi-use form. In larger warewashing machines, a large quantity of composition may be provided in a compartment that allows for the release of a single dose amount of the composition for each wash cycle. Such a compartment may be provided as part of the warewashing machine or as a separate structure connected to the warewashing machine.

The methods of the invention may further employ one or more rinse steps for the treated articles or surfaces. In an aspect, the commercial use of the alkaline detergent compositions at high temperatures preferably include a rinse step employing a rinse aid, including for example, the disclosure of using rinse aids set forth in U.S. patent application Ser. No. 13/480,031, which is herein incorporated by reference in its entirety.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The materials used in the following Examples are provided herein:

Acusol® 445N: polyacrylic acid sodium salt, commercially-available from Dow Chemical Co.

Bayhibit AM®: 2-phosphonobutane-1,2,4-tricarboxylic acid, commercially-available from Lanxess.

Monoethanolamine phosphonate scale inhibitor, obtained from Champion Technologies.

Example 1

A liquid alkaline detergent composition according to the invention was formulated for comparison to a control composition containing caustic and a phosphonate (Bayhibit AM, 50%) shown below in Table 3. The experimental formula (EXP1) according to the invention was calculated to have approximately the same percent actives phosphonate and the same actives use concentration as the Control formula at the time of the experiment (700 ppm).

TABLE 3

| Description | Control | EXP1 |
|---|---|---|
| Water | 18 | 18.2 |
| Sodium Hydroxide (beads) | 70.7 | 70.7 |
| Bayhibit AM (50%) | 11.3 | 0 |
| Scale Inhibitor | 0 | 11.1 |
| Active Phosphonate (ppm) | 39.55 | 39.63 |
| Total Actives Use Concentration (ppm) | 700 | 700 |

Additional liquid alkaline detergent compositions according to the invention were formulated for comparison to a control composition containing caustic, a phosphonate (Bayhibit AM, 50%) and a polycarboxylate (Acusol 445N) as shown below in Table 4. The experimental formulas (EXP2 and EXP3) according to the invention were calculated to have approximately the same percent actives phosphonate and the same actives use concentration as the Control formula at the time of the experiment (750 ppm).

TABLE 4

| Description | Control 2 | EXP 2 | EXP 3 |
|---|---|---|---|
| Water | 17.6 | 17.65 | 15.65 |
| Sodium Hydroxide (beads) | 72.8 | 72.8 | 72.8 |
| Acusol 445N (45%) | 6.7 | 6.7 | 6.7 |
| Bayhibit AM (50%) | 2.9 | 0 | 0 |
| Scale Inhibitor | 0 | 2.85 | 2.85 |
| Pluronic N3 | 0 | 0 | 2 |
| Active Phosphonate + polymer (ppm) | 33.5 | 33.5 | 33.5 |
| Total Actives Use Concentration (ppm) | 750 | 750 | 750 |

Additional liquid alkaline detergent compositions according to the invention were formulated for comparison to a control composition containing caustic, a phosphonate (Bayhibit AM, 50%) and a polycarboxylate (Acusol 445N) having increased actives in solution as shown below in Table 5. The experimental formulas (EXP4 and EXP5) according to the invention were calculated to have approximately the same percent actives phosphonate and the same actives use concentration as the Control formula at the time of the experiment (750 ppm).

TABLE 5

| Description | Control 3 | EXP 4 | EXP 5 |
|---|---|---|---|
| Water | 13.7 | 13.77 | 14.24 |
| Sodium Hydroxide (beads) | 72.8 | 72.8 | 72.8 |

TABLE 5-continued

| Description | Control 3 | EXP 4 | EXP 5 |
|---|---|---|---|
| Acusol 445N (45%) | 10 | 10 | 5.96 |
| Bayhibit AM (50%) | 3.5 | 0 | 0 |
| Scale Inhibitor | 0 | 3.43 | 7 |
| Active Phosphonate + polymer (ppm) | 46.9 | 46.9 | 46.9 |
| Total Actives Use Concentration (ppm) | 750 | 750 | 750 |

A 100 cycle glass cleaning experiment was performed using the experimental formulas (EXP) and Controls. The experiment was conducted using six 10 oz. Libby glasses and 4 plastic tumblers in a Hobart AM-15 ware wash machine employing 17 grain water (hard water source). The cycles on the ware wash machine include: 53 L wash tank volume, 2.8 L rinse volume, 40 second wash time and 10 second rinse time. Initially the glasses were prepared using a cleaning cycle to completely remove all film and foreign material from the glass surface.

The ware wash machine controller was set to automatically dispense the indicated amount of detergent into the wash tank. A wash temperature of 150°–160° F. and a rinse temperature of 175°–190° F. were reached. Six clean glasses (G=glass tumblers) and a clean plastic tumbler (P=plastic tumbler) were placed in a Raburn rack (as shown in the figure of Example 1) and the rack was placed inside the dishmachine.

The ware wash machine automatically dispensed into the ware wash machine the detergent compositions to achieve the desired concentration and maintain the initial concentration. After 100 wash cycles, the glasses were dried overnight and then the film accumulation using a strong light source was evaluated. The film ratings are based upon the following measurement scale: (1) no film; (2) trace amount of film that is barely visible under intense spot light conditions, but is not noticeable if the glass is held up to a fluorescent light source; (3) light film when held up to a fluorescent light source; (4) medium film, glass appears hazy when held up to a fluorescent light source; and (5) heavy film, glass appears cloudy when held up to a fluorescent light source.

The light box test standardizes the evaluation of the glasses run in the 100 cycle test. The light box test is based on the use of an optical system including a photographic camera, a light box, a light source and a light meter. The system is controlled by a computer program (Spot Advance and Image Pro Plus). To evaluate the glasses after the 100 cycle test, each glass was placed on the light box resting on its side and the intensity of the light source was adjusted to a predetermined value using a light meter. The conditions of the 100 cycle test were entered into the computer. A picture of the glass was taken with the camera and saved on the computer for analysis by the program. The picture was analyzed using the upper half of the glass in order to avoid the gradient of darkness on the film from the top of the glass to the bottom of the glass, based on the shape of the glass.

Generally, a lower light box rating indicates that more light was able to pass through the glass. Thus, the lower the light box rating, the more effective the composition was at preventing scaling on the surface of the glass. Light box evaluation of a clean, unused glass has a light box score of approximately 12,000 which corresponds to a score of 72,000 for the sum of 6 glasses.

The results of the 100 cycle testing are shown in Table 6.

TABLE 6

| | | Light Box Scores | | |
|---|---|---|---|---|
| Example | Use Concentration | Glasses (sum) | Plastic | Sum Total |
| Control 1 | 700 ppm | 306439 | 37546 | 343985 |
| Example 1 | 700 ppm | 224654 | 65535 | 290189 |
| Control 2 | 750 ppm | 323086 | 54800 | 377886 |
| Example 2 | 750 ppm | 238814 | 37661 | 276475 |
| Example 3 | 750 ppm | 201831 | 58714 | 260545 |
| Control 3 | 750 ppm | 321841 | 25791 | 347632 |
| Example 4 | 750 ppm | 274330 | 22004 | 296334 |
| Example 5 | 750 ppm | 225665 | 21718 | 247383 |

The results demonstrate that all experimental formulations containing the scale inhibitor according to the invention, namely an alkanol amine phosphonate, provided improved cleaning benefits and reducing film on the treated surfaces in comparison to the Control compositions containing the phosphonate (Bayhibit AM, 50%). The results further demonstrate additional benefit of formulating scale inhibitors compositions to include both the alkanol amine phosphonate in combination with a polymer, such as a polycarboxylate (Acusol 445N), which outperforms Control compositions containing the phosphonate (Bayhibit AM, 50%).

Example 2

Additional liquid alkaline detergent compositions according to the invention were formulated for comparison to a control composition containing caustic and a polycarboxylate (Acusol 445N) having increased actives in comparison to the formulations of Example 1, as shown below in Table 7 (in solution). The experimental formulas (EXP6 and EXP7) according to the invention were calculated to have approximately the same percent actives phosphonate and the same actives use concentration as the Control formula at the time of the experiment (750 ppm).

TABLE 7

| Description | Control 4 | EXP 6 | EXP 7 |
|---|---|---|---|
| Water | 10.2 | 9.6 | 8.72 |
| Sodium Hydroxide (beads) | 72.8 | 72.8 | 72.8 |
| Acusol 445N (45%) | 18.48 | 6 | 11 |
| Bayhibit AM (50%) | 0 | 0 | 0 |
| Scale Inhibitor | 0 | 11 | 6.6 |
| Active Phosphonate + polymer (ppm) | 62.4 | 62.3 | 62.4 |
| Total Actives Use Concentration (ppm) | 750 | 750 | 750 |

The experimental formulas (EXP) and Controls were evaluated using 50-cycle warewash tests to determine the cleaning efficacy of the detergent compositions according to the invention. The 50 cycle experiment for institutional ware wash detergents tests the ability of compositions to clean glass and plastic, 6 10 oz. Libby heat resistant glass tumblers and 1 plastic tumbler were used. The glass tumblers were cleaned prior to use. New plastic tumblers were used for each experiment.

A food soil solution was prepared using a 50/50 combination of beef stew and hot point soil and employed at 4000 ppm soil. The soil included two cans of Dinty Moore Beef Stew (1360 grams), one large can of tomato sauce (822 grams), 15.5 sticks of Blue Bonnet Margarine (1746 grams)

and powered milk (436.4 grams). The hot point soil was added to the machine to maintain a sump concentration of about 4000 ppm.

After filling the dishmachine with 17 grain water, the heaters were turned on. The wash temperature was adjusted to about 150-160° F. The final rinse temperature was adjusted to about 175-190° F. The controller was set to disclose the amount of detergent in the wash tank. The glass and plastic tumblers were placed in the Raburn rack (see figure below for arrangement; P=plastic tumbler; G=glass tumbler) and the rack was placed inside the dishmachine as shown below.

| | | | | | |
|---|---|---|---|---|---|
| | | | | | G |
| | | | | G | |
| | | | G | | |
| | | G | | | |
| | G | | | P | |
| G | | | | | |

The dishmachine was then started and run through an automatic cycle. At the beginning of each cycle the appropriate amount of hot point sol was added to maintain the sump concentration of 4000 ppm. The detergent concentration is controlled by conductivity.

When the 50 cycles ended, the glasses were allowed to dry overnight. Thereafter they were graded for spots and film accumulation (visual).

The glass and plastic tumblers were then graded for protein accumulation using Commas sie Brilliant Blue R stain followed by destaining with an aqueous acetic acid/methanol solution. The Commassie Brilliant Blue R stain was prepared by combining 1.25 g of Commassie Brilliant Blue R dye with 45 mL of acetic acid and 455 mL of 50% methanol in distilled water. The destaining solution consisted of 45% methanol and 10% acetic acid in distilled water.

The amount of protein remaining on the glass and plastic tumblers after destaining was rated visually on a scale of 1 to 5. A rating of 1 indicated no protein was present after destaining—no spots/no film. A rating of 2 indicated that random areas (barely perceptible) were covered with protein after destaining—spots at random (or about 20% surface covered in film). A rating of 3 indicated that about a quarter to half of the surface was covered with protein after destaining (or about 40% surface covered in film). A rating of 4 indicated that about half of the glass/plastic surface was covered with protein after destaining (or about 60% surface covered in film). A rating of 5 indicated that the entire surface was coated with protein after destaining (or at least about 80% surface covered in film).

The ratings of the glass tumblers tested for soil removal were averaged to determine an average soil removal rating from glass surfaces and the ratings of the plastic tumblers tested for soil removal were averaged to determine an average soil removal rating from plastic surfaces. Similarly, the ratings of the glass tumblers tested for redeposition were averaged to determine an average redeposition rating for glass surfaces and the ratings of the plastic tumblers tested for redeposition were averaged to determine an average redeposition rating for plastic surfaces.

The results are shown in Table 8, demonstrating that the detergent compositions according to the invention provide superior cleaning efficacy over Controls products.

TABLE 8

| | Spotting Scores | | | | |
|---|---|---|---|---|---|
| | Sum of Film Scores | | Sum of Spot Scores | | Sum |
| | Glass | Plastic | Glass | Plastic | Total |
| Control 4 | 30 | 5 | 16.5 | 1 | 52.5 |
| EXP 6 | 18 | 4 | 19 | 1.5 | 42.5 |
| EXP 7 | 21 | 5 | 18 | 1 | 45 |

The results further demonstrate beneficial scale control in comparison to polyacrylates-only alkaline detergent. Beneficially, the results described herein are obtained in the presence of food soils and therefore further provide additional antiredeposition properties in addition to scale control.

The inventions being thus described, it will be obvious that the same may be varied in many ways. Such variations are not to be regarded as a departure from the spirit and scope of the inventions and all such modifications are intended to be included within the scope of the following claims. The above specification provides a description of the manufacture and use of the disclosed compositions and methods. Since many embodiments can be made without departing from the spirit and scope of the invention, the invention resides in the claims.

What is claimed is:

1. An alkaline detergent composition for removing scale and/or inhibiting formation thereof comprising:

an alkali metal alkalinity source;

an alkanol amine phosphonate scale inhibitor, wherein the alkanol amine phosphonate scale inhibitor is a combination of a linear alkanol amine phosphonate and cyclic alkanol amine phosphonate in a weight ratio of about 1:5 to about 5:1;

water; and optionally a water conditioning polymer;

wherein a use solution of the composition has a pH from about 9 to about 12.5 and from about 1 ppm to about 75 ppm of the scale inhibitor.

2. The composition of claim 1, wherein the alkalinity source is an alkali metal hydroxide.

3. The composition of claim 2, wherein the alkali metal hydroxide is sodium hydroxide.

4. The composition of claim 1, wherein the alkanol amine phosphonate scale inhibitor is a combination linear alkanol amine phosphonate and cyclic alkanol amine phosphonate in a weight ratio of about 1:2 to about 2:1.

5. The composition of claim 1, wherein the alkanol amine phosphonate scale inhibitor comprises linear and cyclic monoethanolamine phosphonates.

6. The composition of claim 5, wherein the linear and cyclic monoethanolamine phosphonates are in a weight ratio of about 1:2 to about 2:1.

7. The composition of claim 1, wherein the water conditioning polymer is selected from the group consisting of aminocarboxylic acids, salts of aminocarboxylic acids, carboxylic acids, salts of carboxylic acids, polycarboxylic acids, salts of polycarboxylic acids, and combinations thereof.

8. An alkaline detergent use solution composition for removing scale and/or inhibiting formation thereof comprising:

from about 100 ppm to about 800 ppm alkali metal alkalinity source;

from about 1 ppm to about 75 ppm alkanol amine phosphonate scale inhibitor;

water; and from about 1 ppm to about 100 ppm water conditioning polymer;

wherein the use solution has a pH from about 9 to about 12.5.

9. The composition of claim 8, wherein the alkalinity source is an alkali metal hydroxide and/or alkali metal carbonate.

10. The composition of claim 8, wherein the alkali metal hydroxide is sodium hydroxide.

11. The composition of claim 8, wherein the alkanol amine phosphonate scale inhibitor comprises a combination of linear and cyclic monoethanolamine phosphonates in a weight ratio of about 1:2 to about 2:1.

12. The composition of claim 8, wherein the water conditioning polymer is selected from the group consisting of aminocarboxylic acids, salts of aminocarboxylic acids, carboxylic acids, salts of carboxylic acids, polycarboxylic acids, salts of polycarboxylic acids, and combinations thereof.

13. The composition of claim 8, wherein the alkanol amine phosphonate scale inhibitor is a combination of linear and cyclic monoethanolamine phosphonates in a weight ratio of about 1:2 to about 2:1, and wherein the water conditioning polymer is a polycarboxylic acid and/or salt of a polycarboxylic acid.

14. The composition of claim 8, wherein the use solution pH is from about 8 to about 10.

15. The composition of claim 8, wherein the composition is substantially-free of 2-phosphonobutane-1,2,4-tricarboxylic acid (PBTC) and/or 1-HydroxyEthylidene-1,1-Diphosphonic Acid (HEDP) phosphonates and/or phosphonic acids.

16. A method of cleaning using an alkaline detergent comprising:

providing an alkaline detergent composition of claim 1; and contacting a surface or article in need of cleaning in a washing step with the detergent composition, wherein the temperature of the washing step employing the detergent composition is at least about 150° F.

17. The method of claim 16, further comprising diluting the alkaline detergent composition with water at a ratio of detergent to water from about 1:500 to about 1:5000 to generate a use solution of the alkaline detergent composition prior to contacting said surface or article.

18. The method of claim 16, wherein the alkalinity source comprises an alkali metal hydroxide and/or alkali metal carbonate, wherein the alkanol amine phosphonate scale inhibitor comprises a combination of linear and cyclic monoethanolamine phosphonates in a weight ratio of about 1:2 to about 2:1, and wherein the water conditioning polymer is selected from the group consisting of aminocarboxylic acids, salts of aminocarboxylic acids, carboxylic acids, salts of carboxylic acids, polycarboxylic acids, salts of polycarboxylic acids, and combinations thereof.

19. The method of claim 16, wherein the composition comprises from about 100 ppm to about 800 ppm alkali metal alkalinity source, from about 1 ppm to about 25 ppm alkanol amine phosphonate scale inhibitor, and from about 1 ppm to about 100 ppm water conditioning polymer.

20. The method of claim 16, wherein said alkaline detergent composition provides superior scale control in comparison to alkaline detergents containing alternative phosphonates.

* * * * *